US005842836A

United States Patent [19]

Tarutani et al.

[11] Patent Number: 5,842,836

[45] Date of Patent: Dec. 1, 1998

[54] RECIPROCATING PISTON TYPE REFRIGERANT COMPRESSOR HAVING A HOUSING WITH ENHANCED SEALING FUNCTION

[75] Inventors: Tomoji Tarutani; Noriyuki Shintoku; Tomohiro Wakita; Atsuko Toyama, all of Kariya, Japan

[73] Assignee: Kabushiki Kaisha Toyoda Jidoshokki Seisakusho, Kariya, Japan

[21] Appl. No.: 591,359

[22] Filed: Jan. 25, 1996

[30] Foreign Application Priority Data

Jan. 31, 1995 [JP] Japan ..... 7-014608

[51] Int. Cl.[6] ..... F04B 1/12

[52] U.S. Cl. ..... 417/269; 92/71

[58] Field of Search ..... 417/902, 269, 417/559, 571; 92/71; 91/499

[56] References Cited

U.S. PATENT DOCUMENTS

| | | | |
|---|---|---|---|
| 3,380,651 | 4/1968 | Niki et al. | 417/196 |
| 4,070,136 | 1/1978 | Nakayama et al. | 417/269 |
| 4,101,250 | 7/1978 | Nakayama et al. | 417/269 |
| 4,403,921 | 9/1983 | Kato et al. | 417/296 |
| 4,407,638 | 10/1983 | Sasaya et al. | 417/269 |
| 4,683,803 | 8/1987 | Miller et al. | 417/269 |
| 4,717,313 | 1/1988 | Ohno et al. . | |
| 5,607,287 | 3/1997 | Ikeda et al. | 417/269 |

FOREIGN PATENT DOCUMENTS 61-142183 9/1986 Japan .

*Primary Examiner*—Timothy Thorpe
*Assistant Examiner*—Peter G. Korytnyk
*Attorney, Agent, or Firm*—Burgess, Ryan & Wayne

[57] ABSTRACT

A reciprocating piston type compressor having a cylinder block unit closed, at at least one of the axial ends thereof, by a housing having a central suction chamber and a discharge chamber arranged around the suction chamber hermetically isolated by a separation wall integral with the housing, a valve plate interposed between the end of the cylinder block unit and the housing and having suction and discharge ports, suction passageways formed in the cylinder block unit to have fluid communication with the suction chamber via openings thereof, a plurality of pressing ribs axially integrally extending from an inner face of the housing toward the valve plate so as to apply a higher pressure to the valve plate at positions of the valve plate between respective two neighboring openings of the suction passageways in cooperation with the separating wall to prevent deformation of the valve plate due to the high pressure of the refrigerant in the respective cylinder bores whereby the hermetic seal between the valve plate and the end of the cylinder block is ensured.

5 Claims, 3 Drawing Sheets

RECIPROCATING PISTON TYPE REFRIGERANT COMPRESSOR HAVING A HOUSING WITH ENHANCED SEALING FUNCTION

BACKGROUND OF THE INVENTION

1. Field of the Invention

The present invention relates generally to a reciprocating piston type refrigerant compressor, and more particularly, relates to the internal sealing construction of a reciprocating piston type refrigerant compressor.

2. Description of the Related Art

Many reciprocating piston type compressors are used for compressing a gas-phase refrigerant which is a cooling medium in a refrigerating system such as an automobile air refrigerating system or an automobile climate control system. The reciprocating piston type compressor can be either a fixed capacity type compressor or a variable capacity type compressor, and includes a swash-plate operated reciprocating piston type compressor, and a wobble-plate operated reciprocating piston type compressor.

The swash-plate operated reciprocating piston type compressor is usually provided with a plurality of double-headed pistons reciprocating in respective axial cylinder bores formed in a cylinder block assembly which constructs a main body portion of the compressor in cooperation with front and rear housings.

The wobble-plate operated reciprocating piston type compressor is usually provided with a plurality of single-headed pistons reciprocating in respective cylinder bores formed in a cylinder block provided to construct a compressor body in cooperation with a crank case and a housing.

The cylinder block assembly, i.e., axially combined front and rear cylinder blocks of the swash-plate operated double-headed reciprocating piston type compressor has axially front and rear ends closed by the front and rear housings via valve plates. The cylinder block assembly, the front and rear housings, and the valve plates, i.e., front and rear valve plates are axially tightly combined by a plurality of long screw bolts. The swash-plate operated double-headed reciprocating piston type compressor has an inlet port for introducing a gas-phase refrigerant to be compressed into a low pressure region, namely a swash plate chamber formed in the compressor body, and an outlet port for delivering the compressed gas-phase refrigerant toward the refrigerating or climate control system. The introduced gas-phase refrigerant in the swash plate chamber flows through suction passageways into suction chambers formed in the front and rear housings, and is then sucked into the respective cylinder bores via suction valves which are moved to the open positions thereof from the closed positions thereof in response to reciprocation of the double-headed pistons operated by the swash plate mounted on a rotating drive shaft. The gas-phase refrigerant is compressed by the reciprocating double-headed pistons in the respective cylinder bores, and is subsequently discharged from the cylinder bores into discharge chambers formed in the front and rear housings via discharge valves which are moved to the open positions thereof from the closed positions thereof in response to the reciprocation of the double-headed pistons. The compressed gas-phase refrigerant at high pressure is further delivered from the discharge chambers of the front and rear housings toward an external refrigerant conduit connected to the refrigerating system via delivery passageways in the compressor body and the above-mentioned outlet port.

The suction and discharge chambers of the front and rear housings are formed so that either the suction chambers are arranged in generally central portions of the housings to be circumferentially surrounded by the discharge chambers via an annularly extending separating wall or, to the contrary, the discharge chambers are arranged in central portions of the housings so as to be circumferentially surrounded by the suction chambers. The former arrangement of the suction and discharge chambers has an advantage in that since the central suction chambers of the front and rear housings are arranged at positions apt to be fluidly communicated with shaft sealing devices mounted on the drive shaft, the shaft sealing devices can be cooled by the gas-phase refrigerant in the suction chambers and lubricated by lubricant suspended in the refrigerant. Further, the internal construction of the front and rear housings can be simpler.

For example, FIG. 4 illustrates an internal construction of one of the front and rear housings, i.e., the front housing of the conventional swash-plate operated double-headed piston type compressor having five cylinder bores on each of the front and rear sides. From the illustration of FIG. 4, it is understood that the round front housing 5 is provided with a suction chamber 14 at a central portion thereof and a discharge chamber 16 surrounding the suction chamber 14. The suction chamber 14 is formed in a non-circular chamber having five radial protrusions, and is fluidly isolated by a non-circular curved separating wall 30 which extends so as to wind close to outer semi-circular boss portions having therein a through-hole permitting a long screw bolt to extend through, and suction ports 18 formed in the valve plate so as to open toward the suction chamber 14.

In the above-described construction of the front housing 5, when the gas-phase refrigerant is compressed in the respective cylinder bores 11 of the cylinder block assembly so as to become a high pressure gas-phase refrigerant, the high pressure of the gas-phase refrigerant directly acts on the valve plate arranged between the end of the cylinder block assembly and the front housing 5. Thus, the central portion of the valve plate facing the suction chamber 14 and located far away from portions being in tight contact with the above-mentioned semi-circular boss portions of the front housing 5 by a tightening force of the long screw bolts is partly deformed by the high pressure of the compressed gas-phase refrigerant, and is urged to be separated away from the end of the cylinder block assembly due to the deformation thereof. The separation of the valve plate from the end of the cylinder block assembly increases with a portion of the valve plate which is located far away from the non-circular curved separating wall 30 pressing the valve plate toward the end of the cylinder block assembly.

At this stage, it should be noted that the suction passageways 28 formed in the cylinder block assembly for introducing the gas-phase refrigerant from the low pressure swash plate chamber into the suction chamber 14 are arranged very close to the opening of the respective cylinder bores 11. Namely, only a small distance "s" is left between the respective cylinder bores 11 and the respective suction passageways 28. Therefore, when the above-mentioned separation of the valve plate occurs, small gaps cause a failure of the hermetic seal between the end of the cylinder block assembly and the planar face of the valve plate, and permit the compressed high pressure gas-phase refrigerant to directly escape from the respective cylinder bores 11 into the suction passageways 28 to be mixed with the gas-phase refrigerant before compression. Accordingly, a problem occurs in that the compression efficiency of the swash-plate operated reciprocating piston type compressor is reduced. Further, the high pressure gas-phase refrigerant escaping into the suction passageways 28 and the suction chamber 14 heats the gas-phase refrigerant before compression therein, and accordingly, the refrigerating performance of the refrigerating system is degraded.

Although the above description is provided with respect to an example of the swash-plate operated double-headed reciprocating piston type compressor, the described problems similarly occur with respect to the conventional wobble-plate operated single-headed reciprocating piston type compressor having a cylinder block element, a crank case, and a single housing, i.e., a rear housing attached to the rear end of the cylinder block element, via a valve plate, and having a suction chamber and a discharge chamber therein. Namely, when the wobble-plate operated single-headed reciprocating piston type compressor is provided with a crank chamber in the interior of the crank case, and when the crank chamber is provided for receiving gas-phase refrigerant to be compressed, and communication with the suction chamber through suction passageways formed in the cylinder block element, the compressor must be similarly subjected to the above-described unfavorable problems.

SUMMARY OF THE INVENTION

Therefore, an object of the present invention is to provide a novel internal sealing construction of a reciprocating piston type refrigerant compressor, which is able to eliminate the afore-mentioned problems.

Another object of the present invention is to provide an novel sealing construction of a housing of a reciprocating piston type refrigerant compressor, whereby the escape of compressed gas-phase refrigerant from the cylinder bores into a suction part of the compressor, due to the deformation of the valve plate or plates, can be prevented.

In accordance with the present invention, there is provided a reciprocating piston type compressor which includes a cylinder block means formed as a part of a body of the compressor and having a plurality of cylinder bores formed therein to extend between two axial ends of the cylinder block means, in parallel with one another, around a central axis thereof, a plurality of pistons arranged in the respective cylinder bores to be reciprocated therein for sucking a refrigerant before compression, compressing the refrigerant, and discharging the compressed refrigerant, a valve plate member attached to one of the axial ends of the cylinder block means and having a plurality of suction and discharge ports formed therein to be communicated with the respective cylinder bores, suction and discharge valve members provided for closing and opening the suction and discharge ports in response to reciprocation of the plurality of pistons, a housing provided for closing one of the axial ends of the cylinder block via the valve plate member, the housing being provided with an inner face and an outer wall portion axially extending from a peripheral portion of the inner face and having a flat end being in press contact with the valve plate member, the housing defining in a region surrounded by the outer wall portion, a central suction chamber and an outer discharge chamber around the suction chamber, the suction chamber and the discharge chamber being hermetically isolated by a separating wall member integrally formed with the housing and being in press contact with the valve plate member to press the valve plate member against one of the axial ends of the cylinder block means, and, a plurality of open-ended suction passageway means formed in the cylinder block means so as to extend between respective two neighboring cylinder bores of the plurality of cylinder bores to thereby provide a fluid communication between a suction part in the compressor body and the suction chamber of the housing, wherein the compressor further comprises a plurality of rib members formed integrally with the housing to press the valve plate member against one of the axial ends of the cylinder block means at positions of the valve plate member located between respective two neighboring openings of the suction passageway means, in cooperation with the separating wall, the separating wall member and the plurality of rib members axially extending from the inner face of the housing toward the valve plate member and having pressing end faces, respectively, and wherein each of the pressing end faces of the rib members is arranged to have an axial length of extension larger than an axial length of extension of the outer wall portion having the flat end, with respect to the inner face of the housing.

Preferably, the axial length of projection of each of the rib members is larger than that of axial length of projection of the outer wall portion by a dimension ranging from 0.05 mm to 0. 15 mm.

Further preferably, the axial length of projection of the separation wall having the pressing end is larger than the axial length of projection of the outer wall portion, but is smaller than the axial length of projection of the rib members.

The suction part of the body of the compressor may be either a suction chamber or a crank chamber communicating with an external refrigerating system via an inlet port of the compressor for receiving the refrigerant before compression when the refrigerant returns from the external refrigerating system.

BRIEF DESCRIPTION OF THE DRAWINGS

The above and other objects, features and advantages of the present invention will be made more apparent from the ensuing description of a preferred embodiment thereof with reference to the accompanying drawings wherein.

DESCRIPTION OF THE PREFERRED EMBODIMENT OF THE PRESENT INVENTION

Figure 1:
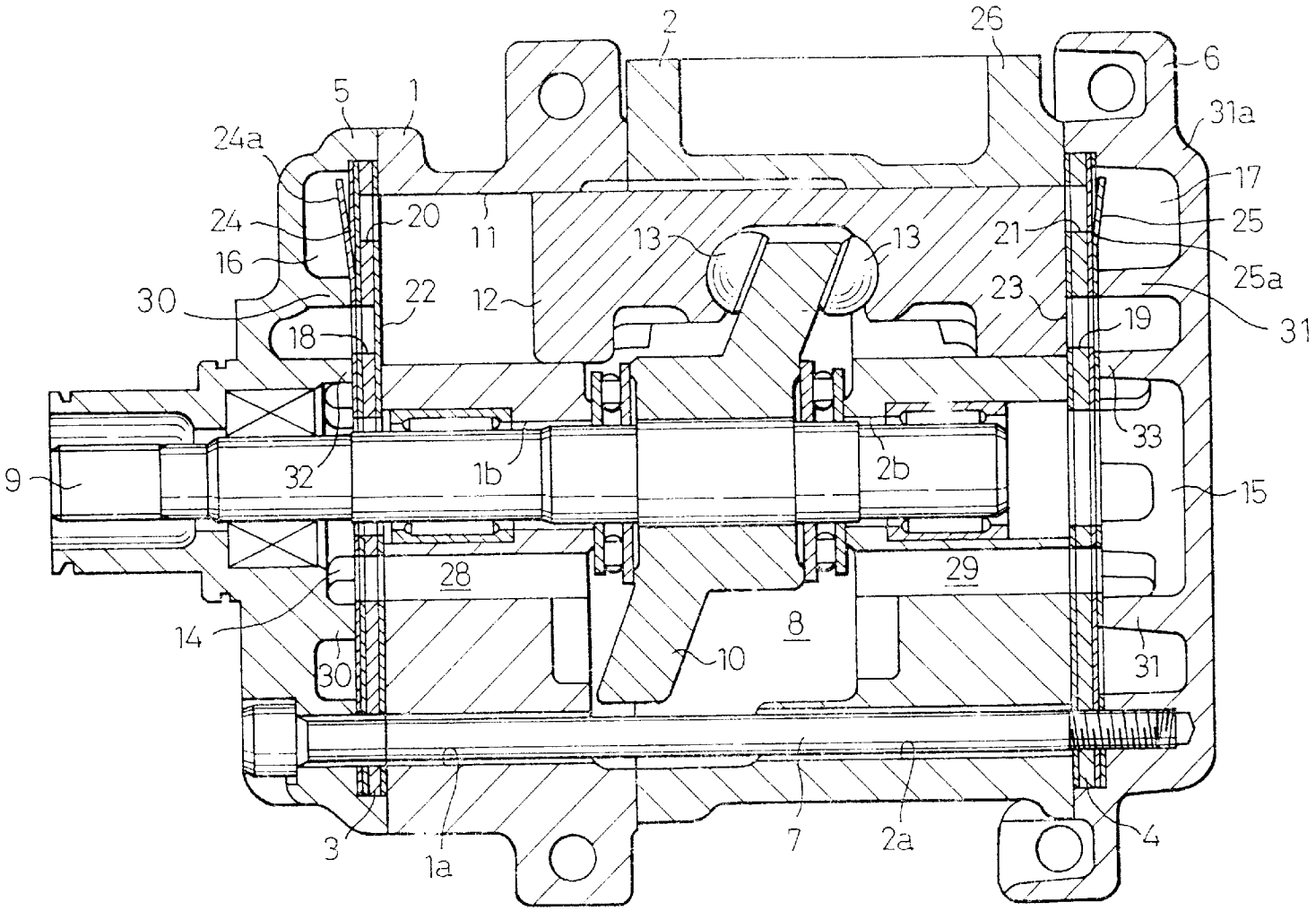
FIG. 1 is a longitudinal cross-sectional view of a swash-plate operated double-headed reciprocating piston type compressor provided with a novel internal sealing construction according to a preferred embodiment of the present invention.
Figure 2:
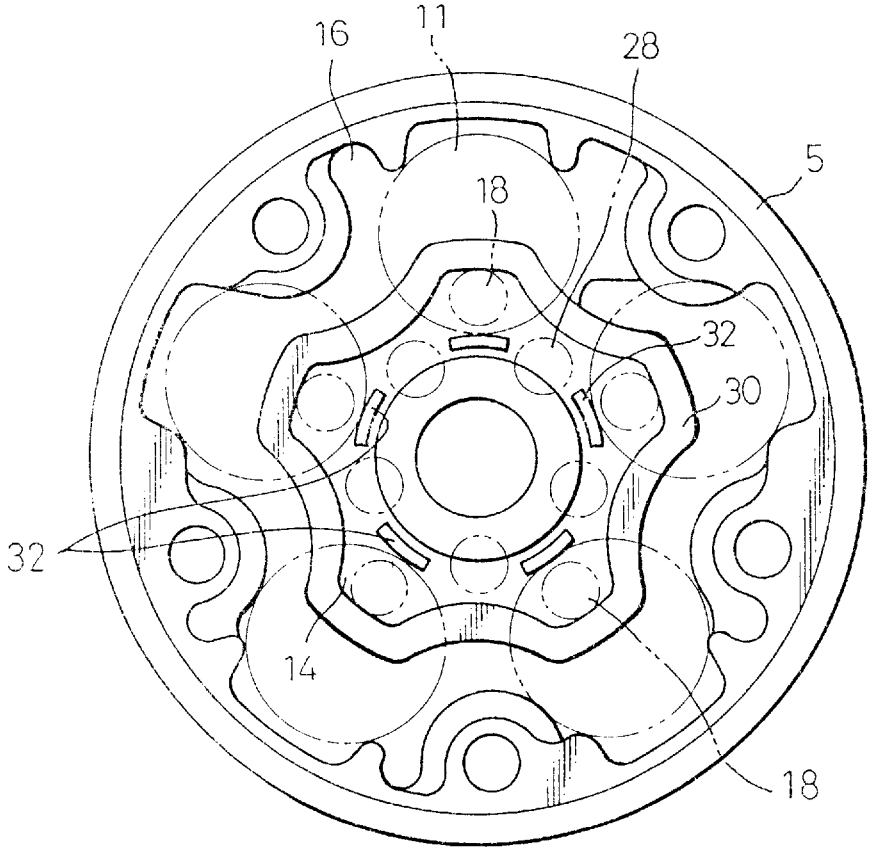
FIG. 2 is an end view of a front housing of the compressor of FIG. 1, illustrating an internal construction of the housing.
Figure 3:
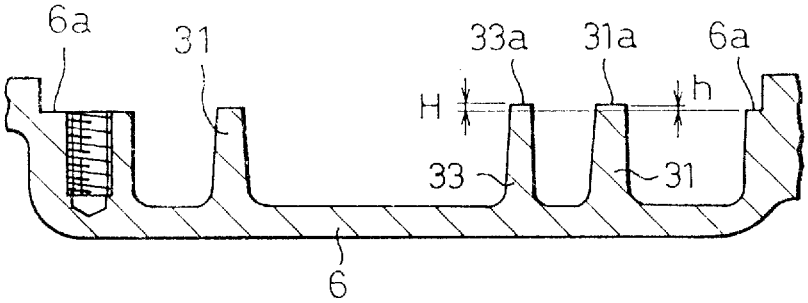
FIG. 3 is a cross-sectional view of a rear housing of the compressor of FIG. 1, illustrating an important portion of an internal construction thereof.

Referring to FIGS. 1 through 3, a swash-plate operated double-headed reciprocating piston type refrigerant compressor is provided with a generally round cylinder block assembly including a front cylinder block 1 and a rear cylinder block 2 axially tightly combined together. The axially combined cylinder block assembly has a front and a rear end closed by front and rear housings 5 and 6 via front and rear valve plates 3 and 4. The combined cylinder block assembly, the front and rear valve plates 3 and 4, and the front and rear housings 5 and 6 are tightly connected by a plurality of long screw bolts 7 inserted through through-bores 1*a* and 2*a* of the front and rear cylinder blocks 1 and 2. At the connecting portion of the front and rear cylinder blocks 1 and 2, a swash plate chamber 8 is provided for receiving a swash plate 10 fixedly mounted on an axial drive shaft 9 arranged so as to axially extend through coaxial central shaft bores 1*b* and 2*b*. The axial drive shaft 9 is supported by front and rear anti-friction bearings to be rotated about an axis of rotation thereof, and has a front end portion thereof extending through the front housing 5 so that it is connected to a drive source such as an automobile engine via a non-illustrated transmission mechanism.

The front and rear cylinder blocks 1 and 2 of the cylinder block assembly are provided with five front and five rear cylinder bores 11 coaxially extending therethrough and in parallel with the axis of rotation of the drive shaft 9. The front and rear cylinder bores 11 slidably receive therein five double-headed piston elements 12 which are engaged with the swash plate 10 via semi-spherical shoes 13. Thus, when the swash plate 10 is rotated together with the axial drive shaft 9, the pistons 12 are reciprocated in the respective cylinder bores 11.

The front and rear housings 5 and 6 are provided with central suction chambers 14 and 15, and outer discharge chambers 16 and 17 arranged so as to surround the central suction chambers 14 and 15, respectively. The central suction chambers 14 and 15 in the front and rear housings 5 and 6 are hermetically separated from the outer discharge chambers 16 and 17 by front and rear separating walls 30 and 31 in the form of continuous walls. The separating walls 30 and 31 project axially from an inner face of each of the front and rear housings 5 and 6, and have end faces in press contact with the front and rear valve plates 3 and 4. The front and rear valve plates 3 and 4 are provided with a plurality (five) of front and rear suction ports 18 and 19 formed therein, respectively, for providing a fluid communication between the respective cylinder bores 11 and the front and rear suction chambers 14 and 15. Namely, a gas-phase low pressure refrigerant is sucked from the suction chambers 14 and 15 into the front and rear cylinder bores 11 via the front and rear suction ports 18 and 19 in response to the reciprocation of the double-headed pistons. The front and rear valve plates 3 and 4 are also provided with a plurality (five) of front and rear discharge ports 20 and 21 formed therein for providing a fluid communication between the front and rear cylinder bores 11 and the front and rear discharge chambers 16 and 17. Namely, the high pressure gas-phase refrigerant after compression is discharged from the respective front and rear cylinder bores 11 into the discharge chambers 16 and 17 via the front and rear discharge ports 20 and 21, in response to reciprocation of the pistons 12.

It should be noted that each of the separation walls 30 and 31 is formed in a continuous non-circular curved wall extending so as to wind close to the peripheral boss portions of the front and rear housings 5 and 6, and the suction ports 18 and 19 of the front and rear valve plates 3 and 4. The peripheral boss portions of the front and rear housings 5 and 6 are provided for forming through-bores into which the afore-mentioned long screw bolts 7 are inserted.

Suction valves 22 and 23 are arranged so as to be sandwiched between the front and rear valve plates 3 and 4, and the front and rear axial ends of the combined cylinder block assembly, and discharge valves 24 and 25 together with retainer elements 24 and 25 are arranged so as to be sandwiched between the front and rear valve plates 3 and 4, and the front and rear housings 5 and 6.

The rear cylinder block 2 is provided with a mount member 26 attached to an upper portion thereof so as to be connectable with a flange member, and the mount member 26 is provided with a non-illustrated inlet port formed therein so as to introduce a gas-phase refrigerant before compression into the swash plate chamber 8. The swash plate chamber 8 is communicated with the front and rear suction chambers 14 and 15 via suction passageways 28 and 29 formed in the front and rear cylinder blocks 1 and 2. The suction passageways 28 and 29 are arranged between two respective neighboring cylinder bores 11 of the front and rear cylinder blocks 1 and 2, and are located in a radially central portion of the front and rear cylinder blocks 1 and 2. The suction passageways 28 and 29 permit the gas-phase refrigerant before compression to flow from the swash plate chamber 8 toward the front and rear suction chambers 14 and 15 in response to reciprocation of the double-headed pistons 12.

The above-mentioned mount member 26 is also provided with a non-illustrated delivery port which is communicated with the discharge chambers 16 and 17 via discharge passageways (not shown in FIGS. 1 through 3) formed in the front and rear cylinder blocks 1 and 2. Thus, the gas-phase refrigerant after compression is delivered from the front and rear discharge chambers 16 and 17 toward an external refrigerant conduit connected to the external refrigerating system, via the above-mentioned discharge passageways and delivery port.

In the above-described swash-plate operated reciprocating double-headed piston type compressor, in accordance with the present invention, the front and rear housings 5 and 6 are equally provided with a novel sealing construction for preventing the compressed high pressure refrigerant from escaping directly from the respective cylinder bores 11 toward the suction passageways 28.

The description of the novel sealing construction of the front and rear housings 5 and 6 will be provided below with reference to the illustration of FIGS. 2 and 3. FIG. 2 is an end view of front housing 5 and FIG. 3 is a cross-sectional view of rely housing 6. It is noted that the end view of rear housing 6 is substantially similar to FIG. 2 and the cross-sectional view of front housing 5 is substantially similar to FIG. 3 and as such, additional Figures showing these views is not necessary. Similar structural features between the front and rear housings, if not shown in either FIG. 2 or 3, are to be inferred from the corresponding shown Figure. For example, the structure of reference numerals 32*a*, 5*a* and 30*a*, corresponds to the shown structure of reference numerals of 32*a*, 6*a* and 31*a*.

The front and rear housings 5 and 6 having the central suction chambers 14 and 15, the outer discharge chambers 16 and 17, and the separating walls 30 and 31 are further provided with a plurality of pressing ribs 32 and 33 arranged in the suction chambers 14 and 15 so as to press the front and rear valve plates 3 and 4 against the front and rear axial ends of the cylinder block assembly in cooperation with the separating walls 30 and 31. The pressing ribs 32 and 33 in the form of axial projections integral with and extending from the inner face of the front and rear housings 5 and 6 are located at respective positions between respective two neighboring openings of the suction passageways 28 and 29. The pressing ribs 32 and 33 in the form of the axial projections have end faces 32*a* and 33*a* which are in press contact with the front and rear valve plates 3 and 4 so that an axial pressure preventing the valve plates 3 and 4 from being moved away and separated from the front and rear axial ends of the cylinder block assembly is constantly applied to the valve plates 3 and 4.

At this stage, the front and rear housings 5 and 6 are provided with respective outer peripheral walls axially extending from the outer peripheral portion of the inner face of the front and rear housings 5 and 6. The outer peripheral walls have flat pressing faces 5*a* and 6*a* in press contact with outer peripheries of the front and rear valve plates 3 and 4 so that the two valve plates 3 and 4 are tightly sandwiched by the outer peripheral walls of the front and rear housings 5 and 6 and the front and rear ends of the cylinder block assembly. However, the end faces 32*a* and 33*a* of the pressing ribs 32 and 33 are formed to have a larger axial length compared with an axial length of the outer peripheral walls of the front and rear housings 5 and 6 with respect to the inner faces of the housings 5 and 6. Namely, the end faces 32*a* and 33*a* of the pressing ribs 32 and 33 can apply a pressure to the valve plates 3 and 4 which is larger than that applied by the pressing ends 5*a* and 6*a* of the outer peripheral walls to the valve plates 3 and 4. As best shown in FIG. 3, the axial length of the pressing ribs 32 and 33 is larger than that of the outer peripheral walls by an amount "H" which is predetermined to be 0.05 mm through 0.15 mm.

Further, the end faces 30*a* and 31*a* of the separation walls 30 and 31 are formed to be situated at a level axially higher than the flat pressing ends 5*a* and 6*a* of the outer peripheral walls by an amount "h" which is predetermined to be smaller than the above-mentioned amount "H" of the pressing ribs 32 and 33.

In the above-described compressor according to the preferred embodiment of the present invention, when the swash plate 10 is rotated together with drive shaft 9, the respective double-headed pistons 12 reciprocate in the respective front and rear cylinder bores 11 to compress the gas-phase refrigerant. Namely, the gas-phase refrigerant introduced into the swash plate chamber 8 through the non-illustrated inlet port flows into the suction chambers 14 and 15 via the suction passageways 28 and 29, and is then sucked into the respective cylinder bores 11 via the suction ports 28 and 29 of the front and rear valve plates 3 and 4 in response to the opening of the suction valves 22 and 23 caused by the reciprocation of the respective pistons 12. The sucked refrigerant is subsequently compressed within the respective cylinder bores 11 by the pistons 12 until the pressure of the compressed refrigerant reaches a predetermined level. When the pressure of the compressed refrigerant reaches the predetermined pressure level, the front and rear discharge valves 24 and 25 are opened, and the compressed refrigerant is discharged from the respective cylinder bores 11 into the front and rear discharge chambers 16 and 17 via the discharge ports 20 and 21.

Figure 4:
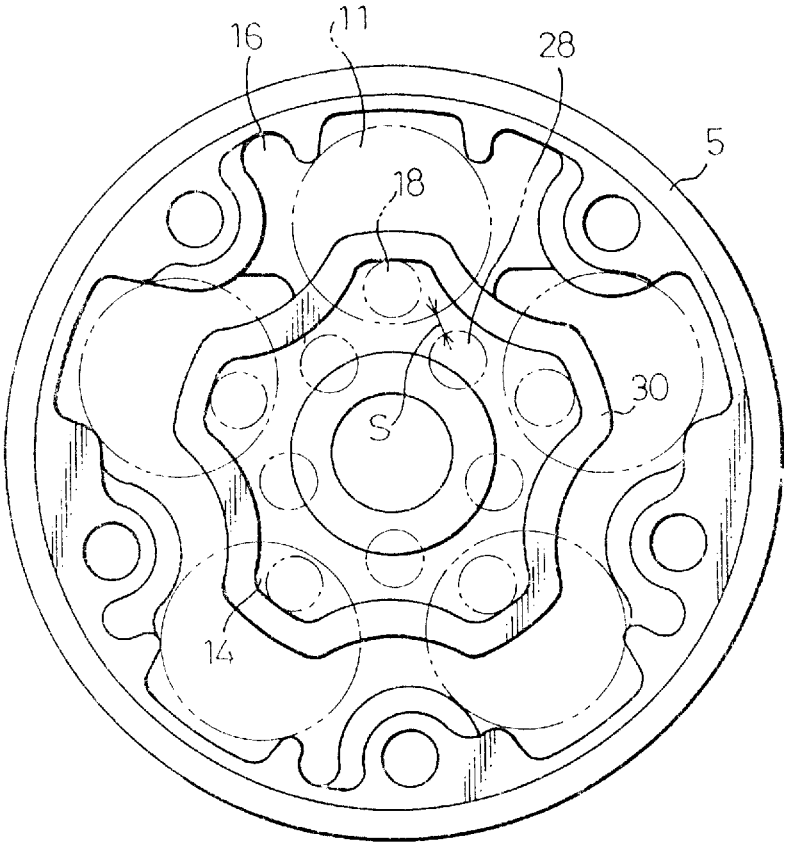
Fig. 4 (PRIOR ART)
FIG. 4 is an end view of a front housing of a reciprocating piston type refrigerant compressor according to the prior art.

The reciprocation of the double-headed pistons 12 in the respective front and rear cylinder bores 11 compresses the gas-phase refrigerant within the respective cylinder bores 11, and therefore, the front and rear valve plates 3 and 4 are urged to be deformed by a high pressure of the compressed refrigerant produced in the respective front and rear cylinder bores 11 against a pressing force given by the front and rear housings 5 and 6 due to tightening of the long screw bolts 7. Particularly, the central portions of the front and rear valve plates 3 and 4 facing the front and rear suction chambers 14 and 15 and located far away from the tightening positions of the long screw bolts 7 are subjected to a strong pressure from the compressed refrigerant. Namely, the central portions of the front and rear valve plates 3 and 4 are urged to move away from the front and rear ends of the combined cylinder block assembly during the operation of the compressor. More specifically, in the embodiment having five front and five rear cylinder bores 11, since a distance (see the corresponding distance "s" in FIG. 4) between the opening of each suction passageway 28 or 29 and one of the cylinder bores 11 is very short, the deformation of the valve plates 3 and 4 producing small gaps between the ends of the cylinder block assembly and the inner faces of the front and rear valve plates 3 and 4 provides a direct fluid communication between the front and rear cylinder bores 11 and the suction passageways 28 and 29 through the small gaps, and accordingly, the high pressure compressed refrigerant is apt to escape from the high pressure region to the low pressure region of the compressor. Nevertheless, according to the present invention, the cooperation of the separation walls 30 and 31 and the pressing ribs 32 and 33 arranged adjacent to the openings of the suction passageways 28 and 29 and to the respective cylinder bores 11 applies a sufficient amount of pressure to the two valve plates 3 and 4 so that the front and rear valve plates 3 and 4 are kept in tight contact with the axial ends of the front and rear cylinder blocks 1 and 2, and that the valve plates 3 and 4 are prevented from deforming. At this stage, as described before, since the end faces 32*a* and 33*a* of the pressing ribs 32 and 33 are formed to have a larger axial length (by the amount of "H" shown in FIG. 3) than the axial length of the outer peripheral walls of the front and rear housings 5 and 6 with respect to the inner faces of the housings 5 and 6, a stronger pressure is applied to the central portions of the front and rear valve plates 3 and 4 so as to surely prevent deformation of the front and rear valve plates 3 and 4 at the positions close to the openings of the suction passageways 28 and 29. Thus, an occurrence of the afore-mentioned direct fluid communication between the suction passageways 28 and 29 and the respective front and rear cylinder bores 11 can be prevented. Moreover, since the respective pressing ribs 32 and 33 in the suction chambers 14 and 15 are mutually spaced away from one another, these pressing ribs 32 and 33 do not obstruct smooth flowing of the gas-phase refrigerant in the suction chambers 14 and 15.

Further, since the end faces 30*a* and 31*a* of the separation walls 30 and 31 are formed to be situated at a level axially higher than the flat pressing ends 5*a* and 6*a* of the outer peripheral walls with respect to the inner faces of the front and rear housings 5 and 6, by the amount "h" (see FIG. 3) which is smaller than the amount "H" of the pressing ribs 32 and 33, the separation walls 30 and 31 can apply, to the valve plates 3 and 4, a pressure which is larger than the pressure applied by the outer peripheral portions of the front and rear housings 5 and 6, and is smaller than the pressure applied by the pressing ribs 32 and 33. Namely, a distribution of pressure applied to the entire surface of each of the front and rear valve plates 3 and 4 can be optimized in relation to the pressure of the compressed refrigerant within the front and rear cylinder bores 11. As a result, the hermetical sealing not only between the axial ends of front and rear cylinder blocks 1 and 2 of the cylinder block assembly and the front and rear valve plates 3 and 4, but also between the suction chambers 14 and 15 and the discharge chambers 16 and 17 can be stably maintained during the operation of the compressor.

In this connection, the afore-mentioned amount "H" of the pressing ribs 32 and 33 is experimentally predetermined to be 0.05 mm through 0.15 mm. Namely, when the amount "H" is less than 0.05 mm, a pressure sufficient for preventing the deformation of the front and rear valve plates 3 and 4 cannot be applied to the central portions of the valve plates. On the other hand, when the amount "H" is larger than 0.15 mm, a pressure applied by the outer peripheral portions of the housings 5 and 6 to the peripheral portions of the valve plates 3 and 4 is weak, and therefore, the distribution of the pressure applied to the valve plates 3 and 4 by the front and rear housings 5 and 6 is so changed that a stable hermetic sealing, between the front and rear valve plates 3 and 4 and the axial ends of the cylinder block assembly, cannot be ensured.

From the foregoing description of the preferred embodiment, it will be understood that according to the present invention, the novel internal hermetic sealing construction of the reciprocating piston type compressor can be provided to enhance the compression efficiency of the compressor, and to increase the refrigerating performance of the reciprocating piston type refrigerating compressor.

It should be understood that although the description of the present invention was provided with reference to the embodiment of a swash-plate operated double-headed piston type compressor, the present invention can be equally applicable to a single-headed piston type refrigerant compressor such as a wobble-plate operated reciprocating piston type compressor.

What we claim:

1. A reciprocating piston type refrigerant compressor including:

a cylinder block means formed as a part of a body of the compressor and having a plurality of cylinder bores formed therein to extend between two axial ends of the cylinder block means in parallel with one another around a central axis thereof, a plurality of pistons arranged in respective of said cylinder bores to be reciprocated therein for sucking a refrigerant before compression, compressing the refrigerant, and discharging the compressed refrigerant, a valve plate member attached to one of the axial ends of said cylinder block means and having a plurality of suction and discharge ports formed therein to be communicated with said respective cylinder bores, suction and discharge valve members provided for closing and opening said suction and discharge ports in response to reciprocation of said plurality of pistons, a housing provided for closing one of the axial ends of said cylinder block means via said valve plate member, said housing being provided with an inner face and an outer wall portion axially extending from a peripheral portion of said inner face and having a flat end being in press contact with said valve plate member, said housing defining in a region surrounded by said outer wall portion, a central suction chamber and an outer discharge chamber arranged around said suction chamber, said suction chamber and said discharge chamber being hermetically isolated by a separating wall member integrally formed with said housing and being in press contact with said valve plate member to press said valve plate member against one of the axial ends of said cylinder block means, and, a plurality of open-ended suction passageway means formed in said cylinder block means so as to extend between respective two neighboring cylinder bores of said plurality of cylinder bores to thereby provide a fluid communication between a suction part in said compressor body and said suction chamber of said housing, wherein the refrigerant compressor further comprises a plurality of rib members formed integrally with said housing to press said valve plate member against one of the axial ends of said cylinder block means at positions of said valve plate located between respective two neighboring openings of said suction passageway means, in cooperation with said separating wall, said separating wall member and said plurality of rib members axially extending from said inner face of said housing toward said valve plate and having pressing end faces, respectively, and;

wherein each of said pressing end faces of said plurality of rib members is arranged to have an axial length of extension larger than an axial length of extension of said outer wall portion having said flat end, with respect to said inner face of said housing.

2. A reciprocating piston type refrigerant compressor according to claim 1, wherein the axial length of extension of each of said rib members is larger than an axial length of extension of said outer wall portion by a dimension ranging from 0.05 mm to 0.15 mm.

3. A reciprocating piston type refrigerant compressor according to claim 1, wherein said axial length of extension of said separating wall having said pressing end larger than said axial length of extension of said outer wall portion, but is smaller than said axial length of extension of each of said rib members.

4. A reciprocating piston type refrigerant compressor according to claim 1, wherein said plurality of rib members of said housing are arranged to be separated away from one another in said suction chamber of said housing.

5. A reciprocating piston type refrigerant compressor according to claim 4, wherein the number of said plurality of rib members of said housing corresponds to the number of said cylinder bores.

* * * * *